US007511689B2

(12) United States Patent
Uchino et al.

(10) Patent No.: US 7,511,689 B2
(45) Date of Patent: Mar. 31, 2009

(54) DISPLAY DEVICE, METHOD FOR DRIVING THE SAME, AND ELECTRONIC APPARATUS

(75) Inventors: Katsuhide Uchino, Kanagawa (JP); Junichi Yamashita, Tokyo (JP); Takao Tanikame, Kanagawa (JP)

(73) Assignee: Sony Corporation (JP)

( * ) Notice: Subject to any disclaimer, the term of this patent is extended or adjusted under 35 U.S.C. 154(b) by 8 days.

(21) Appl. No.: 11/976,113

(22) Filed: Oct. 22, 2007

(65) Prior Publication Data

US 2008/0111766 A1 May 15, 2008

(30) Foreign Application Priority Data

Nov. 13, 2006 (JP) ..... 2006-306127

(51) Int. Cl.
*G09G 3/30* (2006.01)

(52) U.S. Cl. ..... 345/76; 345/82

(58) Field of Classification Search ..... 345/36, 345/38–39, 45, 76–78, 82–84, 87–88, 90–95, 345/98–100, 204–205, 210–214; 315/169.1, 315/169.3; 340/825.45
See application file for complete search history.

(56) References Cited

U.S. PATENT DOCUMENTS 6,501,466 B1 * 12/2002 Yamagishi et al. ..... 345/204
6,580,408 B1 * 6/2003 Bae et al. ..... 345/76
7,053,875 B2 * 5/2006 Chou ..... 345/92
2006/0066528 A1 * 3/2006 Hara ..... 345/76
2008/0007499 A1 * 1/2008 Kawabe ..... 345/82

FOREIGN PATENT DOCUMENTS

| | | |
|---|---|---|
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |
| JP | 2006-215213 | 8/2006 |
| JP | 2006-293056 | 10/2006 |

OTHER PUBLICATIONS

Japanese Office Action issued Nov. 11, 2008 for corresponding Japanese Application No. 2006-306127.

* cited by examiner

*Primary Examiner*—Richard Hjerpe
*Assistant Examiner*—Mansour M Said
(74) *Attorney, Agent, or Firm*—Rader, Fishman & Grauer PLLC; Ronald P. Kananen

(57) ABSTRACT

A display device includes a pixel array unit and a peripheral circuit unit. The pixel array unit includes first scanning lines arranged in rows; second scanning lines arranged in rows; signal lines arranged in columns; and pixels arranged in a matrix pattern at intersections of the scanning lines and the signal lines. The peripheral circuit unit includes a first scanner to supply first control pulses to the first scanning lines; a second scanner to supply second control pulses to the second scanning lines; and a signal driver to supply video signals to the signal lines. Each of the pixels includes at least a sampling transistor; a driving transistor; an emission time controlling transistor; a holding capacitance; and a light-emitting element.

5 Claims, 18 Drawing Sheets

DISPLAY DEVICE, METHOD FOR DRIVING THE SAME, AND ELECTRONIC APPARATUS

CROSS REFERENCES TO RELATED APPLICATIONS

The present invention contains subject matter related to Japanese Patent Application JP 2006-306127 filed in the Japanese Patent Office on Nov. 13, 2006, the entire contents of which are incorporated herein by reference.

BACKGROUND OF THE INVENTION

1. Field of the Invention

The present invention relates to an active matrix display device including light-emitting elements provided for pixels, and to a method for driving the display device. More specifically, the present invention relates to a technique of correcting variations in emission brightness of respective pixels. Also, the present invention relates to electronic apparatuses including the display device.

2. Description of the Related Art

A light-emitting element using a phenomenon of emitting light due to an electric field applied to an organic thin film has been known. Such a light-emitting element is called an organic EL element. Under the present circumstances, plane self light-emitting display devices including organic EL elements for pixels are actively developed. The organic EL element is driven with an applied voltage of 10 V or less and consumes low power. Also, since the organic EL element is a self light-emitting element, a lighting member is not required unlike in a liquid crystal display or the like, so that weight saving and thickness saving can be easily realized. Furthermore, the response speed of the organic EL element is very high, about several μs, and thus afterimages do not appear when moving images are displayed.

Among the plane self light-emitting display devices including the organic EL elements, active matrix display devices including thin film transistors as driving elements of pixels are actively developed. The related arts thereof are described in the following documents.

Patent Document 1: Japanese Unexamined Patent Application Publication No. 2003-255856

Patent Document 2: Japanese Unexamined Patent Application Publication No. 2003-271095

Patent Document 3: Japanese Unexamined Patent Application Publication No. 2004-133240

Patent Document 4: Japanese Unexamined Patent Application Publication No. 2004-029791

Patent Document 5: Japanese Unexamined Patent Application Publication No. 2004-093682

SUMMARY OF THE INVENTION

However, variations in operation characteristics, such as threshold voltage and mobility, of transistors and variations in device characteristics of organic EL elements affect emission brightness, and thus those variations need to be corrected in respective pixel circuits. Display devices in which pixel circuits have a threshold voltage correcting function and a mobility correcting function have been developed. The threshold voltage correcting function can correct variations in threshold voltage of the transistors, and the mobility correcting function can correct variations in mobility of the transistors. Particularly, whether correction of mobility can be normally performed has a great influence on image quality in a display device.

Correction of mobility is performed by negatively feeding back a current flowing to a transistor that drives a light-emitting element to a gate potential of the transistor. The mobility of the transistor corresponds to its current driving ability. A large mobility causes the driving transistor to supply a large drive current. This drive current is fed back to the gate side of the driving transistor only in a predetermined correcting period. A large mobility also causes a large amount of feedback, and the gate potential is compressed accordingly, so that the drive current is suppressed. In this way, variations in mobility of driving transistors can be corrected in individual pixel circuits.

The mobility correcting period is determined depending on the time when both a sampling transistor for sampling a video signal and an emission time controlling transistor for controlling emission time of a light-emitting element are in an ON state. The mobility correcting period is preferably the same in all pixel circuits so that mobility can be accurately corrected in the respective pixel circuits. However, operation timing of the sampling transistor and the emission time controlling transistor varies in each pixel, and thus the movement correcting period also varies in each pixel. In recent years, displays capable of outputting high brightness while suppressing a dynamic range of video signals have been demanded, and a difference in brightness caused by slight variations in mobility correcting period has become conspicuous. The difference in brightness among pixels caused by variations in mobility correcting period is a problem to be overcome.

The present invention has been made in view of the above-described problems of the related arts, and is directed to providing a display device capable of suppressing variations in mobility correcting period and eliminating a difference in brightness among pixels, and a method for driving the display device.

According to an embodiment of the present invention, a display device including a pixel array unit and a peripheral circuit unit is provided. The pixel array unit includes first scanning lines arranged in rows; second scanning lines arranged in rows; signal lines arranged in columns; and pixels arranged in a matrix pattern at intersections of the scanning lines and the signal lines. The peripheral circuit unit includes a first scanner to supply first control pulses to the first scanning lines; a second scanner to supply second control pulses to the second scanning lines; and a signal driver to supply video signals to the signal lines. Each of the pixels includes at least a sampling transistor; a driving transistor; an emission time controlling transistor; a holding capacitance; and a light-emitting element. The sampling transistor is turned ON in accordance with the first control pulse, samples the video signal, and allows the holding capacitance to hold the video signal. The driving transistor controls a drive current in accordance with a potential of the video signal held in the holding capacitance. The emission time controlling transistor is turned ON in accordance with the second control pulse and supplies the drive current controlled by the driving transistor to the light-emitting element. The light-emitting element emits light by receiving the drive current while the emission time controlling transistor is in an ON state. The drive current is negatively fed back to the holding capacitance in a correcting period from a first timing when the emission time controlling transistor is turned ON after the sampling transistor has been turned ON to a second timing when the sampling transistor is turned OFF, thereby correcting variations in mobility of the driving transistor among the pixels. The first scanner forms an edge of the first control pulse defining the second timing by using a first enable signal supplied from the outside. The second scanner forms an edge of the second control pulse defining the first timing by using a second enable signal supplied from the outside.

Preferably, the correcting period is optimized by adjusting a phase difference between the first enable signal and the second enable signal. Each of the pixels has correcting means for correcting variations in threshold voltage of the driving transistor among the pixels.

The mobility correcting period is defined by the first timing when the emission time controlling transistor is turned ON and the second timing when the sampling transistor is turned OFF. According to the related arts, an effect of an enable pulse is applied to a pulse controlling ON and OFF of the sampling transistor and an edge of the control pulse is shaped in order to suppress variations in sampling period a video signal. Accordingly, the second timing when the sampling transistor is turned OFF can be controlled so that variations do not occur in all pixels. However, if the first timing defining the start of the mobility correcting period varies, it may be impossible to make the mobility correcting period constant among the pixels. According to an embodiment of the present invention, an effect of another enable pulse is applied to the pulse controlling ON and OFF of the emission time controlling transistor so as to shape an edge of the control pulse. Accordingly, the first timing defining the start of the mobility correcting period can be fixed in addition to the second timing defining the end of the mobility correcting period, the same mobility correcting period can be obtained in all the pixels, so that a difference in brightness among the pixels can be eliminated.

DESCRIPTION OF THE PREFERRED EMBODIMENTS

Figure 1A:
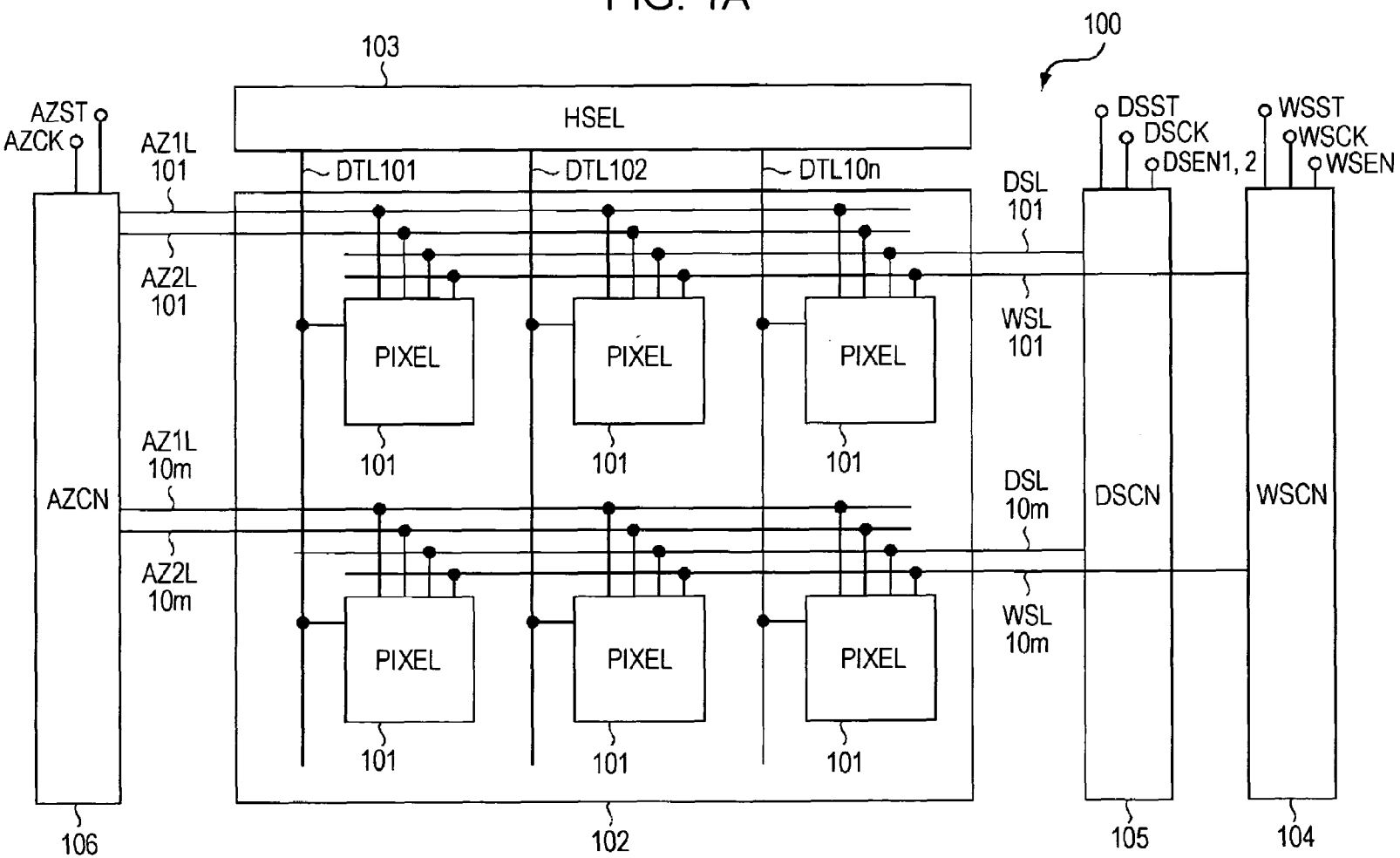
FIG. 1A is a block diagram showing an entire configuration of a display device according to an embodiment of the present invention.

Hereinafter, embodiments of the present invention are described in detail with reference to the drawings. FIG. 1A is a block diagram showing an entire configuration of a display device 100 according to an embodiment of the present invention. As shown in FIG. 1A, the display device 100 includes a pixel array unit 102 and a peripheral circuit unit. The pixel array unit 102 includes first scanning lines WSL arranged in rows, second scanning lines DSL arranged in rows, signal lines DTL arranged in columns, and pixels 101 arranged in a matrix pattern at intersections of the scanning lines WSL and the signal lines DTL. In the example shown in FIG. 1A, the pixels 101 are arranged in m rows and n columns. When the scanning lines WSL are distinguished from each other, they are referred to as "WSL101" (scanning line in a first row), "WSL10m" (scanning line in an m-th row), and the like. This is the same for the second scanning lines DSL. Likewise, when the signal lines DTL are distinguished from each other, they are referred to as "DTL101" (signal line of a first column), "DTL10n" (signal line of an n-th column), and the like.

The peripheral circuit unit includes a first scanner (write scanner WSCN) 104 to supply first control pulses to the first scanning lines WSL, a second scanner (drive scanner DSCN) 105 to supply second control pulses to the second scanning lines DSL, and a signal driver to supply video signals to the signal lines DTL. In this embodiment, a horizontal selector (HSEL) 103 serves as the signal driver, which supplies video signals to the respective signal lines DTL in horizontal cycles in synchronization with line-sequential scanning of the scanning lines WSL.

The peripheral circuit unit also includes a correcting scanner (AZCN) 106, in addition to the write scanner 104 and the drive scanner 105. This correcting scanner AZCN sequentially supplies control pulses to additional scanning lines AZ1L and AZ2L so as to perform a predetermined correcting operation.

The write scanner 104 basically includes shift registers, operates in accordance with a clock signal WSCK supplied from the outside, and sequentially transfers a start pulse WSST supplied from the outside, so as to sequentially output the first control pulses to the scanning lines WSL. Furthermore, the write scanner 104 receives an enable signal WSEN from the outside and shapes the above-described first control pulses. Also, the drive scanner 105 includes shift registers, operates in accordance with a clock signal DSCK supplied from the outside, and sequentially transfers a start pulse DSST supplied from the outside, so as to output the second control pulses to the scanning lines DSL. The drive scanner 105 shapes the second control pulses by using enable signals DSEN1 and DSEN2 supplied from the outside. The correcting scanner 106 also includes shift registers, operates in accordance with a clock signal AZCK, and sequentially transfers a start pulse AZST, so as to output predetermined control pulses to the scanning lines AZ1L and AZ2L. Here, the clock signals WSCK, DSCK, and AZCK have basically the same frequency and the same phase. In some cases, however, phase adjustment may be performed among the clock signals WSCK, DSCK, and AZCK. On the other hand, the start pulses WSST, DSST, and AZST define waveforms of the control pulses required in the respective scanners 104, 105, and 106.

Figure 1B:
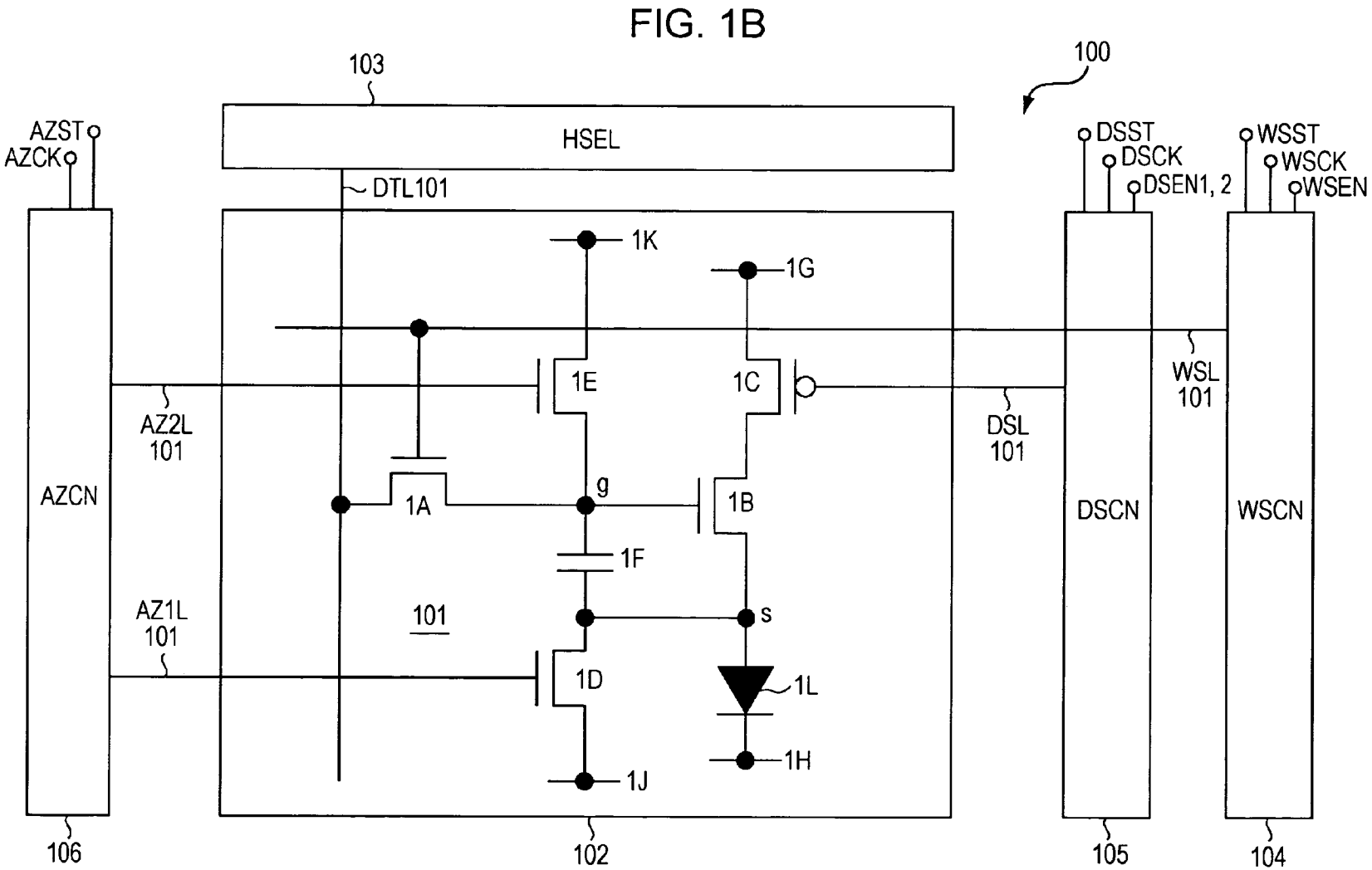
FIG. 1B is a circuit diagram showing a display device according to a first embodiment of the present invention.

FIG. 1B is a circuit diagram according to a first embodiment showing an example of a specific configuration of the pixel 101 included in the display device shown in FIG. 1A. The circuit diagram shown in FIG. 1B illustrates the pixel circuit 101 in the first column and the first row.

As shown in FIG. 1B, the pixel circuit 101 is positioned at the intersection of the scanning lines WSL101, DSL101, AZ1L101, and AZ2L101 and the signal line DTL101, and includes a sampling transistor 1A, a driving transistor 1B, an emission time controlling transistor 1C, a source potential initializing transistor 1D, a reference potential writing transistor 1E, a light-emitting element 1L including an organic EL element or the like, and a holding capacitance 1F. Among the five transistors, only the emission time controlling transistor 1C is P-channel type, and the other transistors 1A, 1B, 1D, and 1E are N-channel type. However, the present invention is not limited to this, but transistors of the P-channel type and N-channel type can be appropriately used together. Also, the number of transistors is not limited to five, as in this embodiment, but can be appropriately selected from the range of about two to seven.

The gate of the sampling transistor 1A connects to the scanning line WSL101, and the drain thereof connects to the video signal line DTL101. The source of the sampling transistor 1A connects to one of electrodes of the holding capacitance 1F, the gate g of the driving transistor 1B, and the source of the reference potential writing transistor 1E. The drain of the driving transistor 1B connects to the emission time controlling transistor 1C, and the source s thereof connects to the other electrode of the holding capacitance 1F, the source potential initializing transistor 1D, and the anode of the light-emitting element 1L. The cathode of the light-emitting element 1L connects to a common power supply line 1H. The source of the emission time controlling transistor 1C connects to a power supply line 1G, and the gate thereof connects to the scanning line DSL101. The drain of the reference potential writing transistor 1E connects to a power supply line 1K, and the gate thereof connects to the scanning line AZ2L101. The source of the source potential initializing transistor 1D connects to a power supply line 1J, and the gate thereof connects to the scanning line AZ1L101.

In this configuration, the sampling transistor 1A is turned ON in accordance with the first control pulse supplied from the write scanner 104, samples the video signal supplied from the signal line DTL101, and allows the holding capacitance 1F to hold a sampling result. The driving transistor 1B controls a drive current in accordance with a signal potential held in the holding capacitance 1F. The emission time controlling transistor 1C is turned ON in accordance with the second control pulse supplied from the drive scanner 105 and supplies a drive current to the light-emitting element 1L via the driving transistor 1B. The light-emitting element 1L emits light by receiving the drive current while the emission time controlling transistor 1C is in an ON state.

The pixel circuit 101 has a mobility correcting function. That is, a drive current is negatively fed back to the holding capacitance 1F during a correcting period: from a first timing when the emission time controlling transistor 1C is turned ON after the sampling transistor 1A has been turned ON to a second timing when the sampling transistor 1A is turned OFF. Accordingly, variations in mobility μ of the driving transistor 1B in the respective pixels can be corrected. At this time, the write scanner 104 forms an edge of the first control pulse defining the second timing by using the enable signal WSEN supplied from the outside, whereas the drive scanner 105 forms an edge of the second control pulse defining the first timing by using the enable signal DSEN2 supplied from the outside. Accordingly, variations in the mobility correcting period can be eliminated so that all the pixels have the same mobility correcting period and that a difference in brightness does not occur. Incidentally, the mobility correcting period can be optimized by adjusting a phase difference between the enable signal WSEN supplied to the write scanner 104 and the enable signal DSEN2 supplied to the drive scanner 105.

The pixel circuit 101 also has a correcting function of correcting variations in threshold voltage Vth of the driving transistor 1B in the respective pixels, in addition to the above-described mobility correcting function. In order to achieve the threshold voltage correcting function, the source potential initializing transistor 1D and the reference voltage writing transistor 1E are provided.

Figure 2A:
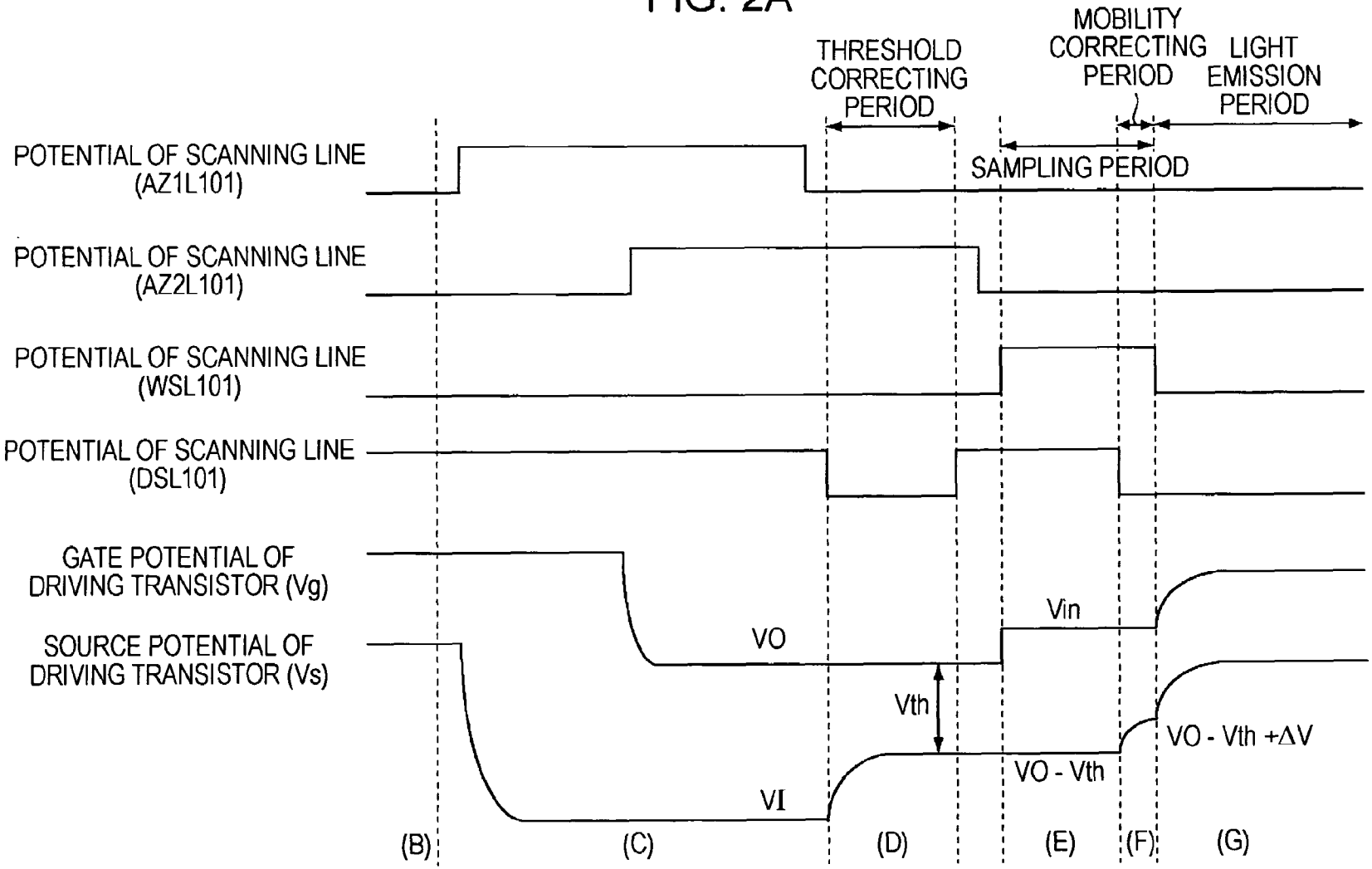
FIG. 2A is a timing chart for illustrating an operation according to the first embodiment.

FIG. 2A is a timing chart for illustrating an operation of the pixel circuit 101 shown in FIG. 1B. This timing chart shows changes in potentials of the scanning lines AZ1L101, AZ2L101, WSL101, and DSL101, and also shows changes in gate potential Vg and source potential Vs of the driving transistor 1B. The change in potential that appears in the scanning line WSL101 corresponds to the first control pulse, and the change in potential that appears in the scanning line DSL101 corresponds to the second control pulse.

In a light-off period (B), the potential of the scanning line DSL101 is in a high level, whereas the potentials of the other scanning lines AZ1L101, AZ2L101, and WSL101 are in a low level. Thus, all the transistors are in an OFF state and no drive current flows to the light-emitting element 1L, so that no light is emitted.

In a preparation period (C), the level of the scanning line AZ1L101 becomes high, and the source potential initializing transistor 1D is tuned ON. Accordingly, the source potential Vs of the driving transistor 1B is initialized to a potential VI supplied from the power supply line 1J. Then, the level of the scanning line AZ2L101 becomes high, and the reference potential writing transistor 1E is turned ON. Accordingly, a reference potential VO supplied from the power supply line 1K is written in the gate g of the driving transistor 1B. That is, the gate potential Vg of the driving transistor 1B is initialized to the reference potential VO. Here, the difference between the reference potential VO and the initializing potential VI is larger than the threshold voltage Vth of the driving transistor 1B. In addition, the initializing potential VI is lower than a cathode potential of the light-emitting element 1L and the light-emitting element 1L is in a reverse bias state, so that no drive current flows.

In a threshold correcting period (D), the level of the scanning line DSL101 becomes low and the emission time controlling transistor 1C is once turned ON. Accordingly, a drive voltage occurs, but the drive voltage does not flow into the light-emitting element 1L because it is in a reverse bias state. The drive current is used only to charge the holding capacitance 1F, so that the source potential Vs gradually rises. The driving transistor 1B is cut off when the voltage between the gate potential Vg fixed at the reference potential VO and the rising source potential Vs becomes just the threshold voltage Vth. The threshold voltage Vth at the cut off is held across the holding capacitance 1F.

In a sampling period (E), the level of the potential of the scanning line WSL101 becomes high and the sampling transistor 1A is turned ON. Accordingly, a signal potential Vin of the video signal supplied from the signal line DTL101 is written in the gate g of the driving transistor 1B. In other words, the gate potential Vg of the driving transistor 1B becomes Vin.

A latter part of the sampling period (E) corresponds to a mobility correcting period (F). The mobility correcting period (F) is a period from the first timing when the emission time controlling transistor 1C is turned ON again after the sampling transistor 1A has been turned ON to the second timing when the sampling transistor 1A is turned OFF. In the mobility correcting period (F), the drive current flowing to the driving transistor 1B is negatively fed back to the holding capacitance 1F in a state where the gate potential Vg of the driving transistor 1B is fixed at the signal potential Vin. At time, the light-emitting element 1L is still in a reverse bias state and no drive current flows thereto, and a part of the drive current is used to charge parasitic capacitance of the light-emitting element 1L, while the other part is negatively fed back to the holding capacitance 1F. Accordingly, the source potential Vs of the driving transistor 1B rises by ΔV. This negative feedback amount ΔV helps suppress variations in the mobility μ of the driving transistor 1B. That is, a large mobility μ of the driving transistor 1B causes a large negative feedback amount ΔV, and thus a gate voltage Vgs applied between the gate g and source s of the driving transistor 1B is compressed accordingly. As a result, the drive current flowing to the driving transistor 1B is suppressed. On the other hand, when the mobility μ of the driving transistor 1B is small, the negative feedback amount ΔV is also small. In this state, the gate voltage Vgs is not strongly compressed, so that a relatively large drive current flows to the driving transistor 1B. In this way, by applying a negative feedback so as to cancel an effect of variations in the mobility μ of the driving transistor 1B, the mobility is corrected.

In a light emission period (G), the potential of the scanning line WSL101 returns to a low level, and thus the gate g of the driving transistor 1B is cut off from the signal line DTL101 side. Accordingly, a boot strap operation becomes possible, and the gate potential Vg rises together with the rise of the source potential Vs. The potential difference Vgs between the source s and the gate g is kept constant. At the time when the light-emitting element 1L enters a forward bias state in accordance with the rise of the source potential Vs, the drive current flows into the light-emitting element 1L, so that the light-emitting element 1L emits light with the brightness according to the gate voltage Vgs. The light-emitting element 1L continues to emit light while the potential of the scanning line DSL101 is in a low level. In other words, the control pulse supplied to the scanning line DSL101 defines the emission time of the light-emitting element 1L. By adjusting the proportion of the light emission time in one field, the brightness of an entire screen can be adjusted.

Figure 2B:
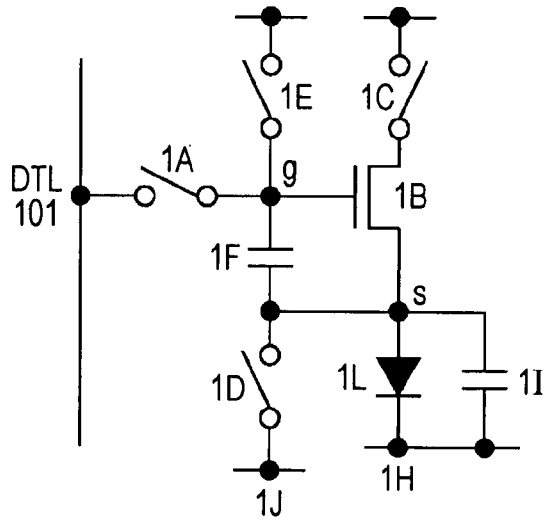
FIG. 2B is a schematic view for illustrating the operation.

The operation of the pixel circuit 101 shown in FIG. 1B is further described with reference to FIGS. 2B to 2G. In these figures, an equivalent capacitance 1I of the light-emitting element 1L is also shown. First, as shown in FIG. 2B, in the light-off period (B), all of the transistors 1A to 1E are in an OFF state and no drive current flows into the light-emitting element 1L. Thus, the light-emitting element 1L is in a light-off state.

Figure 2C:
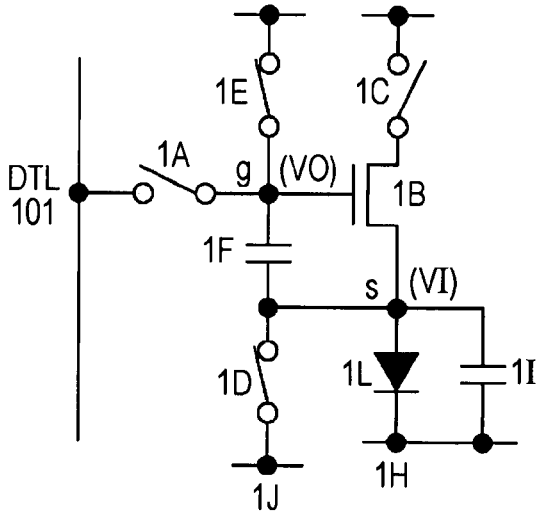
FIG. 2C is a schematic view for illustrating the operation.

As shown in FIG. 2C, in the preparation period (C), the reference potential writing transistor 1E and the source potential initializing transistor 1D are turned ON. Accordingly, the gate g of the driving transistor 1B is reset to the reference potential VO and the source s of the driving transistor 1B is initialized by the initializing potential VI.

Figure 2D:
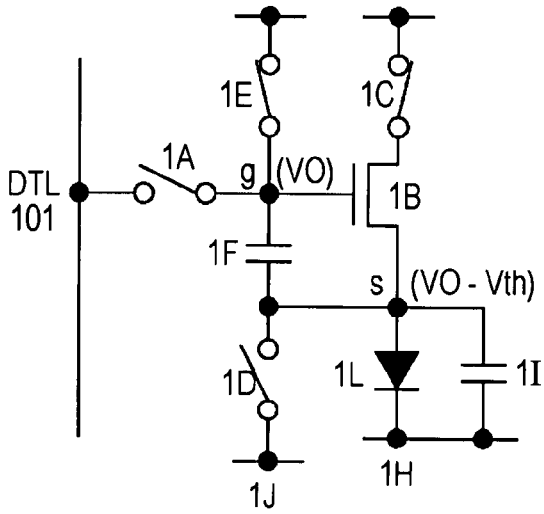
FIG. 2D is a schematic view for illustrating the operation.

As shown in FIG. 2D, in the threshold correcting period (D), the source potential initializing transistor 1D is turned OFF and the emission time controlling transistor 1C is turned ON, so that the drive current is output from the driving transistor 1B. At this time, the drive current does not flow into the light-emitting element 1L because the light-emitting element 1L is in a reverse bias state. The drive current flows into only the holding capacitance 1F and the equivalent capacitance 1I. As a result, the source potential Vs of the driving transistor 1B rises. The driving transistor 1B is cut off when the source potential Vs reaches VO-Vth. At this time, a voltage corresponding to the threshold voltage Vth is applied between the gate g and the source s of the driving transistor 1B, and this voltage is held by the holding capacitance 1F. In this way, the voltage required for cancelling the threshold voltage Vth of the driving transistor 1B is written in the holding capacitance 1F.

Figure 2E:
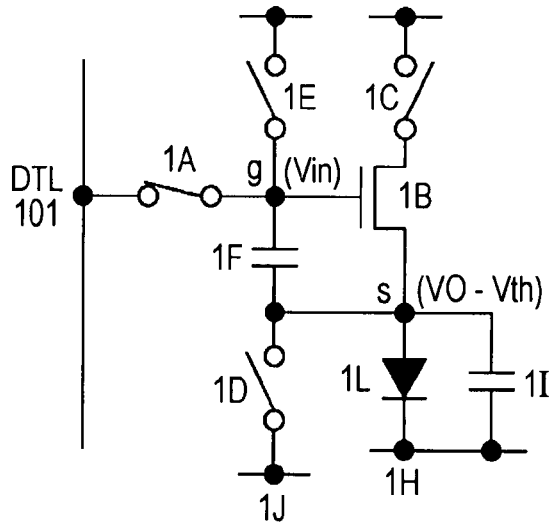
FIG. 2E is a schematic view for illustrating the operation.

As shown in FIG. 2E, in the sampling period (E), the emission time controlling transistor 1C is turned OFF, while the sampling transistor 1A is turned ON. Accordingly, the signal line DTL101 is connected to the gate g of the driving transistor 1B, so that the signal potential Vin of the video signal is written in the gate g of the driving transistor 1B.

Figure 2F:
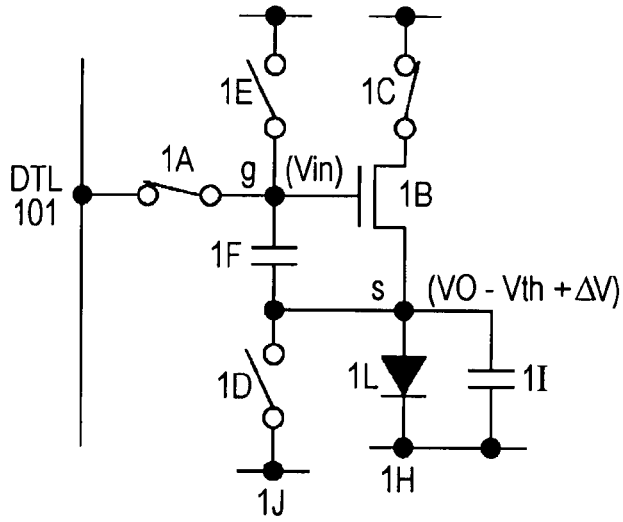
FIG. 2F is a schematic view for illustrating the operation.

As shown in FIG. 2F, in the mobility correcting period (F), the emission time controlling transistor 1C is turned ON. Accordingly, a drive current flows to the driving transistor 1B. At this time, the light-emitting element 1L is in a reverse bias state, and thus the drive current flows into the holding capacitance 1F and the equivalent capacitance 1I. In other words, part of the drive current is negatively fed back to the holding capacitance 1F. In accordance with the amount of current that is negatively fed back during the mobility correcting period (F), the source potential Vs of the driving transistor 1B further rises by ΔV from VO-Vth. The ΔV is the amount of correction for the mobility μ of the driving transistor 1B.

Figure 2G:
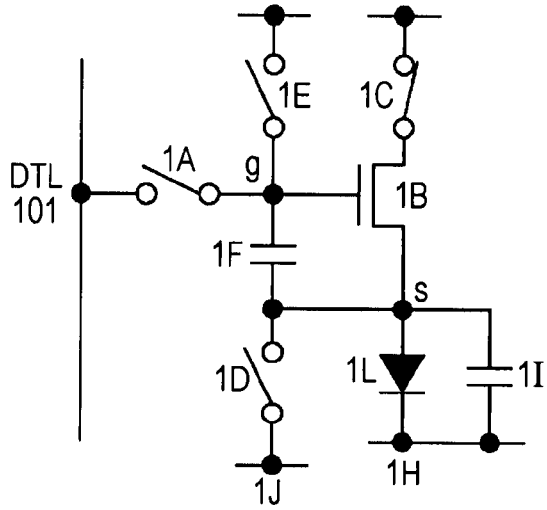
FIG. 2G is a schematic view for illustrating the operation.

As shown in FIG. 2G, in the light emission period (G), the sampling transistor 1A is tuned OFF and the gate g of the driving transistor 1B is cut off from the signal line DTL101, so that a boot strap operation becomes possible. Accordingly, the source potential Vs rises with the voltage Vgs between the gate g and source s of the driving transistor 1B being kept constant. Then, a drive current flows into the light-emitting element 1L when the light-emitting element 1L enters a forward bias state, and the light-emitting element 1L starts to emit light.

Figure 3A:
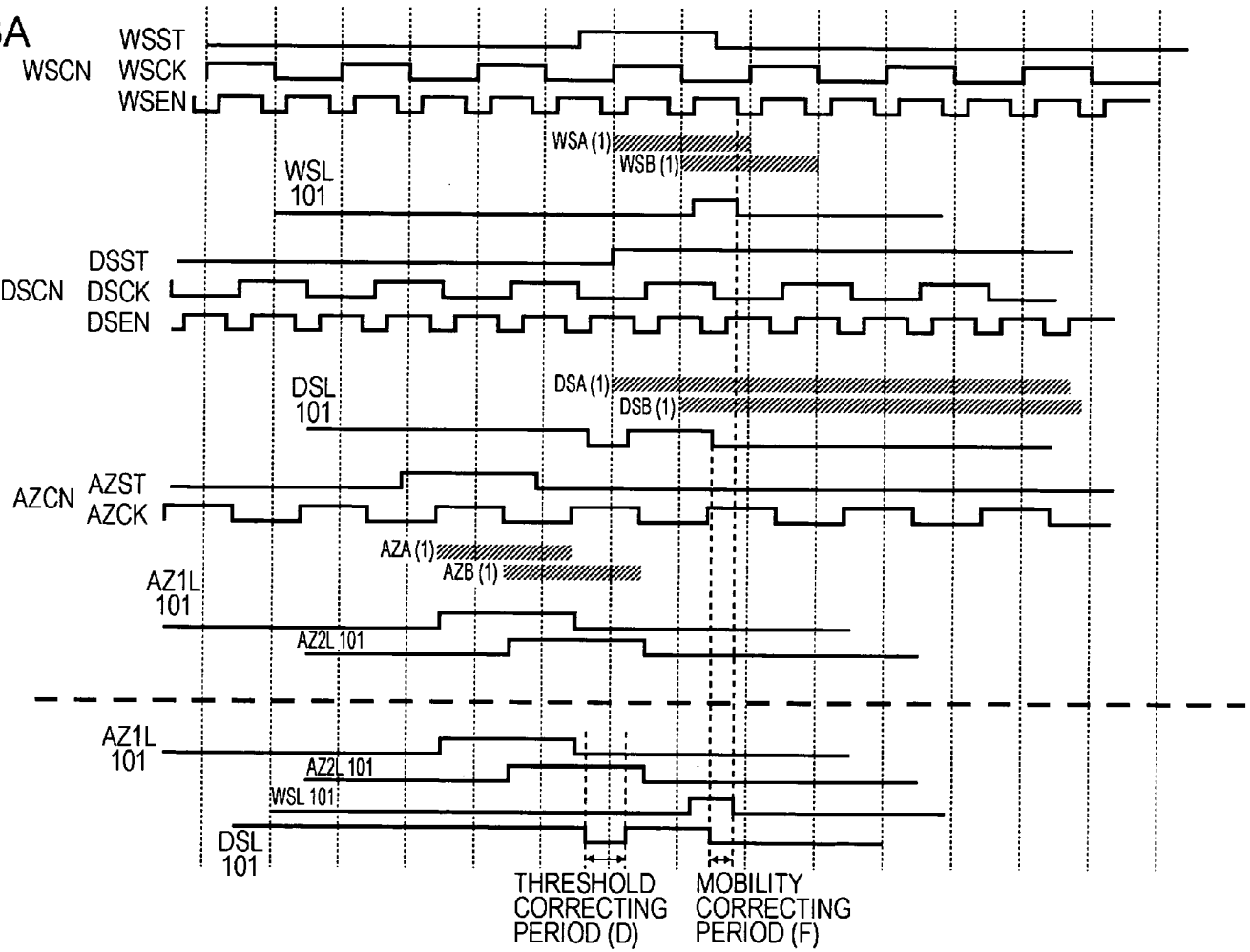
FIG. 3A is a timing chart for illustrating an operation of a display device according to a reference example.

FIG. 3A is a timing chart for illustrating operations of the write scanner WSCN, the drive scanner DSCN, and the correcting scanner AZCN shown in FIG. 1A. The threshold correcting period (D) and the mobility correcting period (E), which are defined by changes in potentials of the scanning lines AZ1L101, AZ2L101, WSL101, and DSL101, are also shown with reference to the time axis of the timing chart.

First, the operation of the write scanner WSCN is described. As described above, the write scanner WSCN basically includes shift registers connected in multistage, operates in accordance with the clock signal WSCK, and sequentially transfers the start pulse WSST so as to output shift pulses in the respective stages. The timing chart shown in FIG. 3A shows a shift pulse WSA (1) input to the shift register in the first stage and a shift pulse WSB (1) output from the shift register in the first stage. As is clear from FIG. 3A, these shift pulses have a waveform of a case where the start pulse WSST is transferred from one stage to another with a half cycle of the clock signal WSCK. The write scanner WSCN performs a logical process on the shift pulses WSA (1) and WSB (1) so as to obtain a control pulse to be supplied to the scanning line WSL101. In the example shown in FIG. 3A, the write scanner WSCN obtains the control pulse by performing an AND process on the shift pulses WSA (1) and WSB (1). Furthermore, the write scanner WSCN processes the control pulse with the enable signal WSEN at its output stage and outputs a final control pulse to the scanning line WSL101. More specifically, a pulse of the enable signal WSEN is extracted by using the pulse that is obtained through the AND process of the shift pulses WSA (1) and WSB (1), and the extracted pulse is used as the final control pulse. The front edge and the back edge of the control pulse correspond to the rising edge and the falling edge of each pulse of the enable signal WSEN, and thus a time lag can be prevented. The enable signal WSEN is supplied to output units of the shift registers in the respective stages, and thus variations in timing in the stages are small. On the other hand, in the pulse obtained through the AND process of the shift pulses WSA (1) and WSB (1), the phase thereof varies in each stage, so that a time lag occurs. In this embodiment, a pulse of the enable signal WSEN is extracted by using the control pulse output from the shift register, so that a final control pulse of stable timing can be obtained. Accordingly, the sampling period (E) can be constant in all the pixels.

The drive scanner DSCN basically includes shift registers connected in multistage, as the write scanner WSCN. The drive scanner DSCN operates in accordance with the clock signal DSCK and sequentially transfers the start pulse DSST so as to obtain shift pulses DSA and DSB. The timing chart shows a shift pulse DSA (1) input to the shift register in the first stage and a shift pulse DSB (1) output from the shift register in the first stage. A control pulse to be supplied to the scanning line DSL1 is obtained by performing a logical process on the shift pulses DSA (1) and DSB (1). At that time, the control pulse is processed with the enable signal DSEN so as to form a waveform of a pulse in a part defining the threshold correcting period (D). Therefore, the threshold correcting period (D) can be controlled to be constant in all the pixels.

The operation of the drive scanner DSCN shown in FIG. 3A is a reference example and is different from that according to the embodiment of the present invention. In this reference example, the enable signal DSEN is used to stably defining the threshold correcting period (D). However, the enable signal is not used for the mobility correcting period (F) and thus variations occur therein. As described above, the mobility correcting period (F) is defined as from the first timing when the potential of the scanning line DSL101 changes from a high level to a low level to the second timing when the potential of the scanning line WSL101 changes from a high level to a low level. The second timing defining the end of the mobility correcting period (F) is determined based on the enable signal WSEN, as described above, and thus no error occurs. However, the first timing defining the start of the mobility correcting period (F) is not defined by using any enable signal, so that an error occurs. This causes variations in the mobility correcting period (F) in the respective lines, so that image quality deteriorates.

The correcting scanner AZCN also includes shift registers connected in multistage, operates in accordance with the clock signal AZCK, and sequentially transfers the start pulse AZST so as to obtain control pulses. The timing chart shows a shift pulse AZA (1) input to the shift register in the first stage and a shift pulse AZB (1) output from the shift register in the first stage. In the correcting scanner AZCN, the shift pulse AZA (1) servers as a control pulse to be supplied to the scanning line AZ1L101 in the first line. Also, the shift pulse AZB (1) servers as a control pulse to be supplied to the scanning line AZ2L101 in the first line.

Figure 3B:
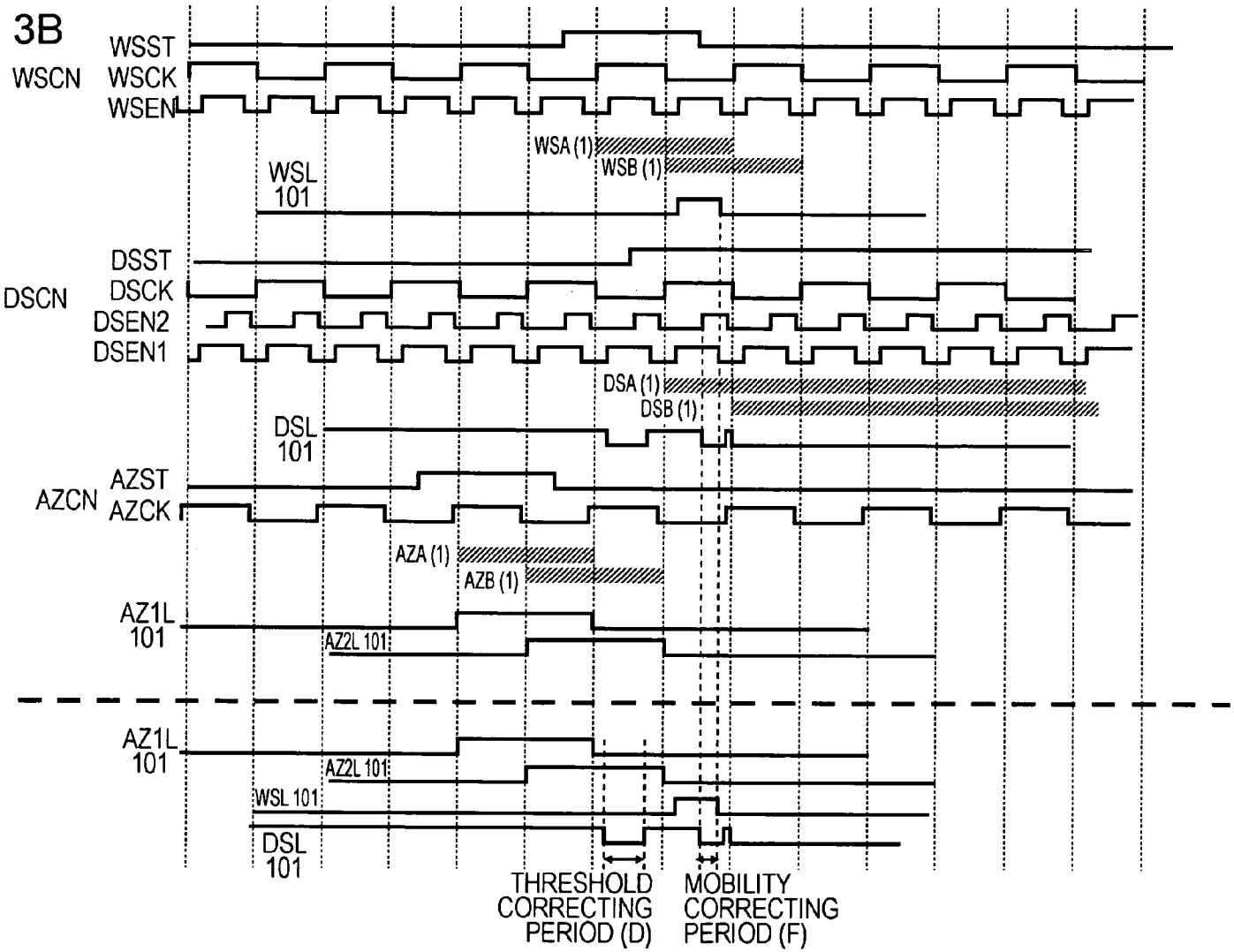
FIG. 3B is a timing chart for illustrating an operation of the display device shown in FIG. 1A.

FIG. 3B is a timing chart showing operations of the respective scanners according to the embodiment of the present invention. For easy understanding, the same illustration manner as that in the reference example shown in FIG. 3A is adopted. The operations of the write scanner WSCN and the correcting scanner AZCN are the same as those in the reference example shown in FIG. 3A. For example, the write scanner WSCN forms a control pulse by using the enable signal WSEN and outputs the control pulse to the scanning line WSL101.

The difference is the operation of the drive scanner DSCN. In this embodiment, two enable signals DSEN1 and DSEN2 are used to form the control pulses to be output to the scanning lines DSL. The enable signal DSEN1 is used to define the threshold correcting period (D) and is the same as the enable signal DSEN in the reference example. By using the enable signal DSEN2, the back edge of each control pulse to be applied to the scanning lines DSL is formed.

As is clear from the bottom of the timing chart shown in FIG. 3B, the start of the mobility correcting period (F) is determined by the rising edge of the enable signal DSEN2, and the end of the mobility correcting period (F) is determined by the falling edge of the enable signal DSEN1. Since both the start and end of the mobility correcting period (F) are defined by the enable signals, no error occurs among lines.

Figure 4A:
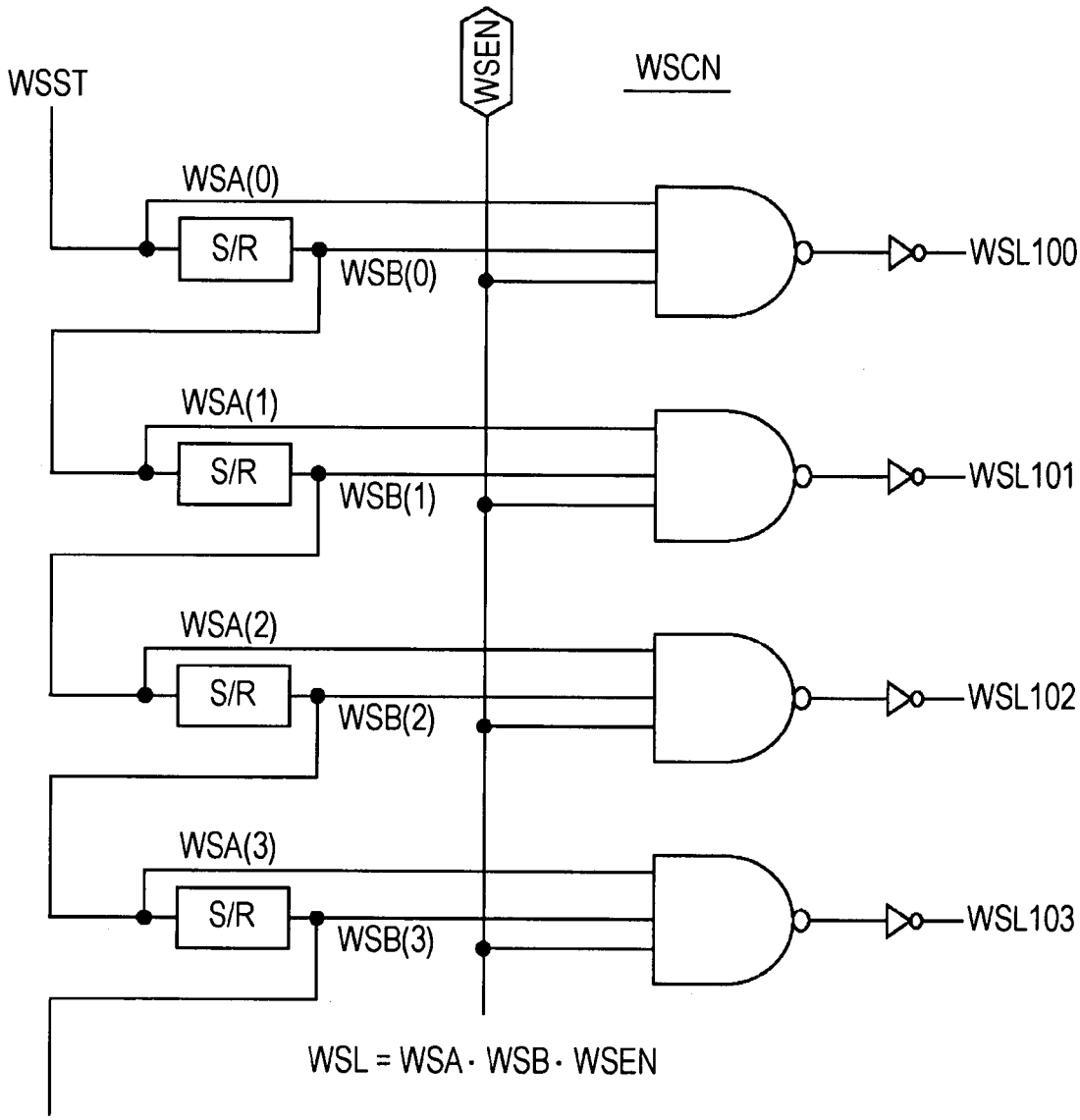
FIG. 4A is a circuit diagram showing an example of a configuration of a write scanner included in the display device shown in FIG. 1A.

FIG. 4A is a circuit diagram showing an example of a configuration of the write scanner WSCN included in the display device according to the embodiment of the present invention. The operation of the write scanner WSCN has been described with reference to the timing chart shown in FIG. 3B. As shown in FIG. 4A, the write scanner WSCN includes shift registers S/R connected in multistage, in which an output gate is provided for each stage. In the shift registers S/R, the start pulse WSST is sequentially transferred, so that shift pulses WSA and WSB are generated in the respective stages. "WSA" represents an input-side shift pulse, whereas "WSB" represents an output-side shift pulse after transfer.

For example, the shift register S/R in the first stage (1) receives the shift pulse WSA (1) supplied from the shift register SIR in the previous stage, delays it by a half cycle of the clock signal WSCN, and outputs the shift pulse WSB (1) to the next stage. The output gate for the first stage includes a NAND gate element of three-input and one-output and an inverter. This output gate performs a NAND process on the shift pulses WSA (1) and WSB (1) and the enable signal WSEN, inverts the result of the process by the inverter, and outputs a final control pulse to the corresponding scanning line WSL101. The logical process performed in the output gate is expressed by a logical expression at the bottom of FIG. 4A.

Figure 4B:
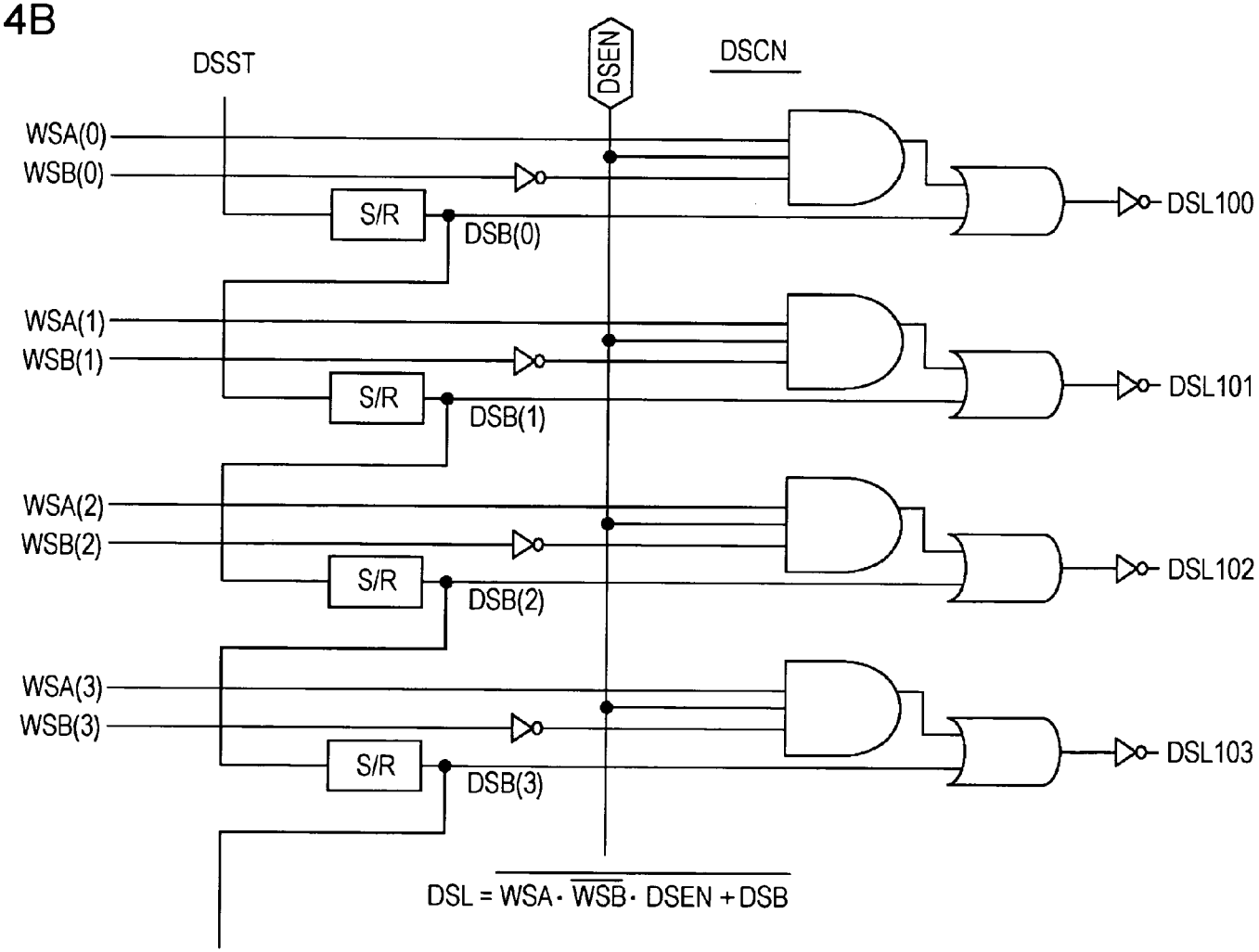
FIG. 4B is a circuit diagram showing a drive scanner according to the reference example.

FIG. 4B is a circuit diagram showing a configuration of the drive scanner DSCN according to the reference example. The operation of the drive scanner DSCN according to the reference example is shown in the timing chart in FIG. 3A. As shown in FIG. 4B, the drive scanner DSCN includes shift registers S/R connected in multistage, in which an output gate is provided for each stage. For example, in the shift register S/R in the first stage (1), the output gate therefore includes an AND element of three-input and one-output, an OR element of two-input and one-output, and an inverter. The shift pulse DSB (1), the enable signal DSEN, and the shift pulses WSA (1) and WSB (1) supplied from the corresponding stage of the write scanner WSCN are supplied to this output gate, a gate process is performed thereon, so that a control pulse to be output to the corresponding scanning line DSL101 is obtained. The logical expression of this gate process is shown at the bottom of FIG. 4B.

Figure 4C:
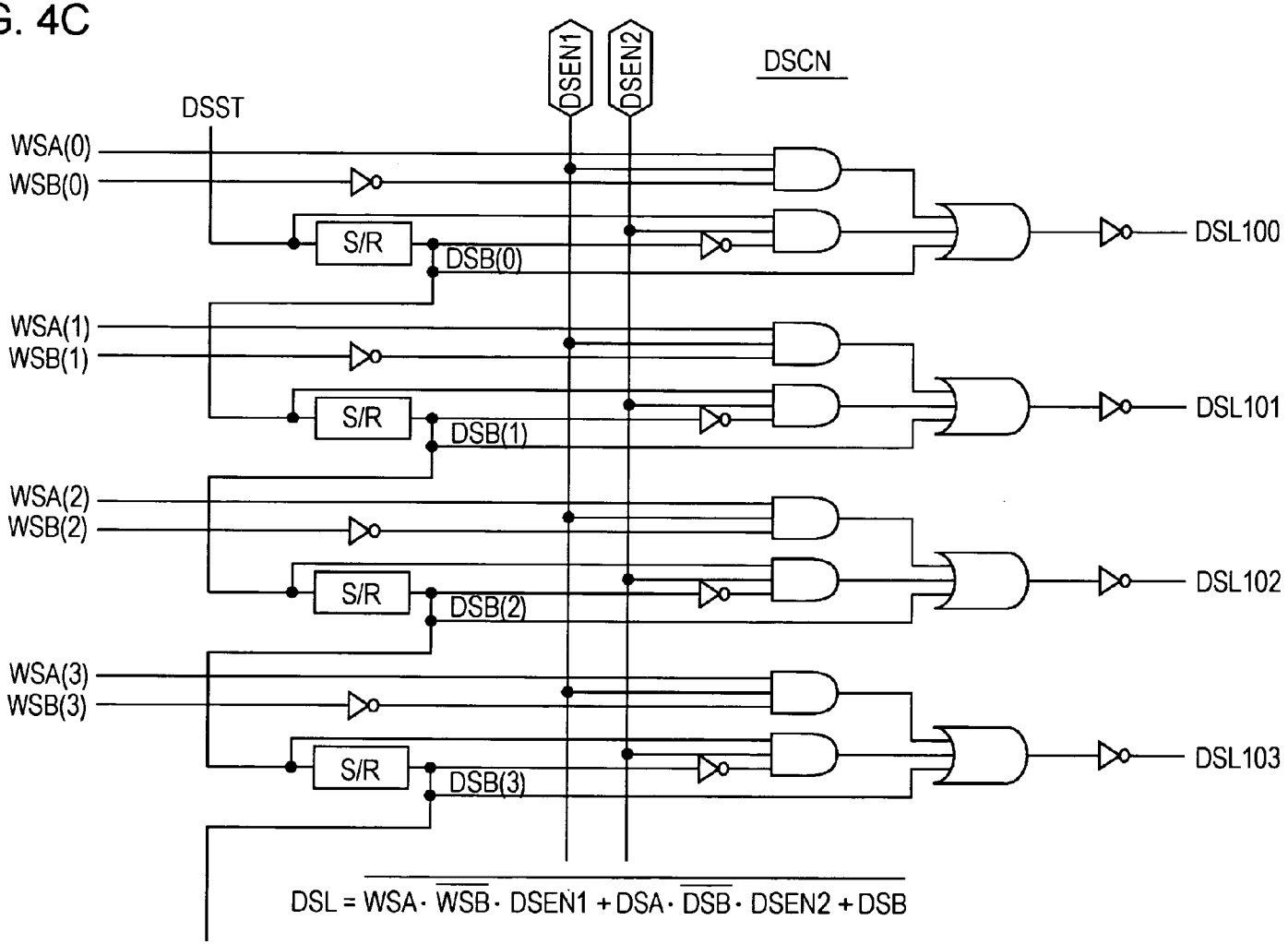
FIG. 4C is a circuit diagram showing an example of a configuration of a drive scanner included in the display device shown in FIG. 1A.

FIG. 4C is a circuit diagram showing an example of a configuration of the drive scanner DSCN according to the embodiment of the present invention. For easy understanding, the parts corresponding to those of the drive scanner DSCN according to the reference example shown in FIG. 4B are denoted by the corresponding reference numerals. A different point is that two enable signals DSEN1 and DSEN2 are supplied to the respective output gates. The enable signal DSEN1 is the same as the enable signal DSEN used in the reference example, but the enable signal DSEN2 is newly added and is particularly used to define the start of the mobility correcting period. For this purpose, an AND gate element of three-input and one-output is also provided in addition to the element of the reference example in each output gate of the drive scanner DSCN. The logical process performed in the output gate is expressed by the logical expression shown at the bottom of FIG. 4C.

Figure 5A:
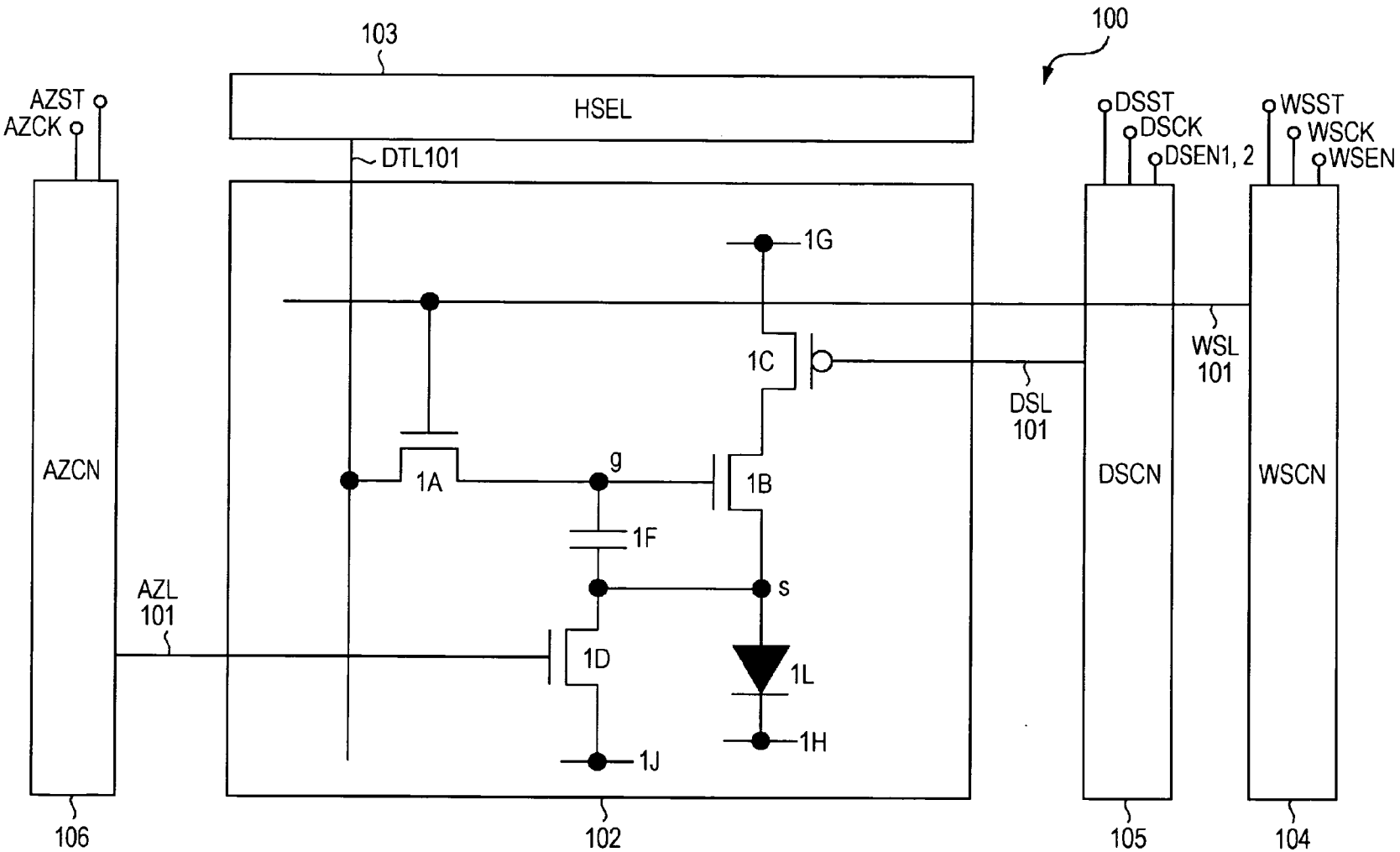
FIG. 5A is a circuit diagram showing a display device according to a second embodiment of the present invention.

FIG. 5A is a circuit diagram showing a display device according to a second embodiment of the present invention. For easy understanding, the parts corresponding to those in the above-described first embodiment shown in FIG. 1B are denoted by the corresponding reference numerals. Also, the illustration manner is the same as that in the circuit diagram shown in FIG. 1B for easy understanding. As is clear from comparison between FIG. 5A and FIG. 1B, the reference potential writing transistor 1E, that is provided in the first embodiment, is not provided in the circuit configuration of this embodiment. In compensation for the reference potential writing transistor 1E, the video signal supplied to the video signal line DTL101 is pulsed.

Figure 5B:
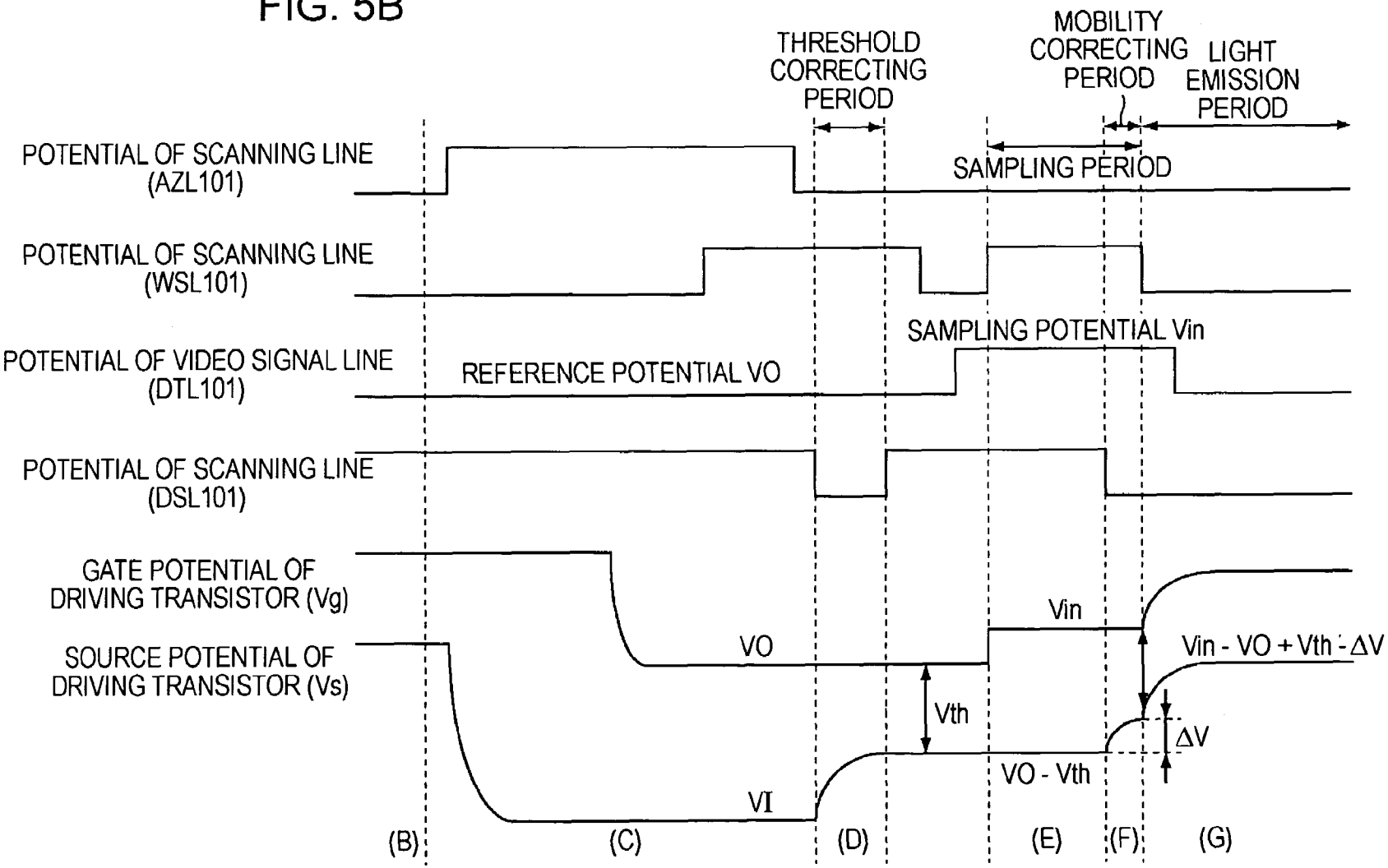
FIG. 5B is a timing chart for illustrating an operation according to the second embodiment.

A sampling potential Vin of the pulsed video signal is shown as the potential of the video signal line DTL101 in the timing chart shown in FIG. 5B. In the first embodiment shown in FIG. 1B, the transistor 1E is turned ON and the reference potential VO is applied to the gate g of the driving transistor 1B for the threshold correcting operation. On the other hand, in this embodiment, the sampling transistor 1A is turned ON after the potential of the signal line DTL101 has been set to the reference potential VO, as shown in the timing chart in FIG. 5B, so that the threshold correcting operation equivalent to that in the first embodiment can be performed. Also, the potential of the signal line is set to the sampling potential Vin during the sampling period and then the sampling transistor 1A is turned ON again, so that sampling of the video signal can be performed. In this embodiment, too, the mobility correcting period (F) is determined depending on the phase difference between the timing when the emission time controlling transistor 1C is turned ON and the timing when the sampling transistor 1A is turned OFF, so that the present invention can be carried out.

Figure 6A:
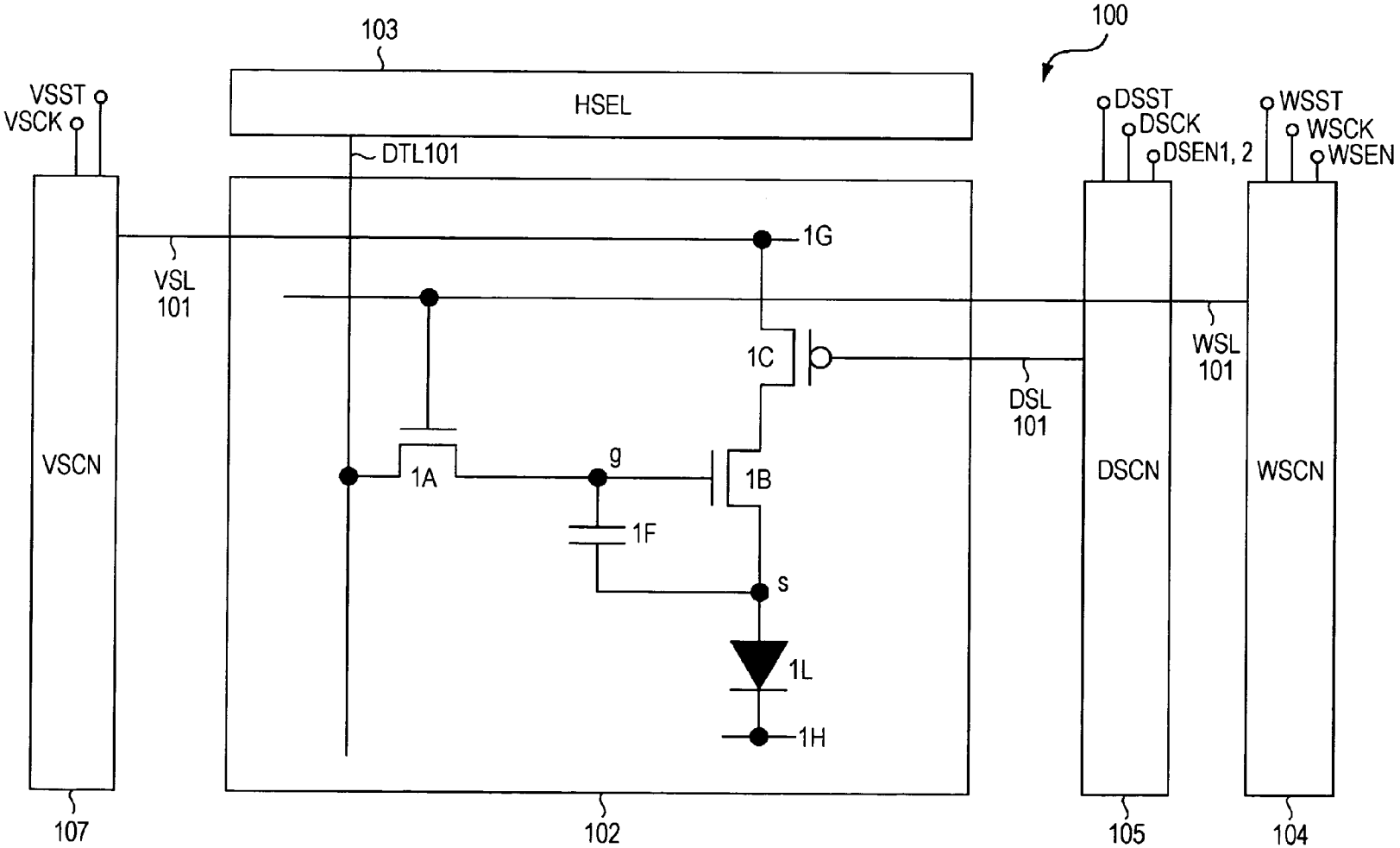
FIG. 6A is a circuit diagram showing a display device according to a third embodiment of the present invention.

FIG. 6A is a circuit diagram showing a display device according to a third embodiment of the present invention. In this embodiment, the source potential initializing transistor 1D is further omitted from the circuit according to the second embodiment shown in FIG. 5A. That is, the circuit according to this embodiment includes three transistors 1A, 1B, and 1C, a holding capacitance 1F, and a light-emitting element 1L. In compensation for the source potential initializing transistor 1D, the power supply line 1G is pulsed. In the circuit diagram shown in FIG. 6A, the power supply line 1G is represented by a scanning line VSL101, which is controlled by an additional scanner for power supply (VSCN) 107. In the second embodiment shown in FIG. 5A, the transistor 1D is turned ON and the initializing potential VI is applied to the source s of the driving transistor 1B in order to initialize the source potential of the driving transistor 1B.

Figure 6B:
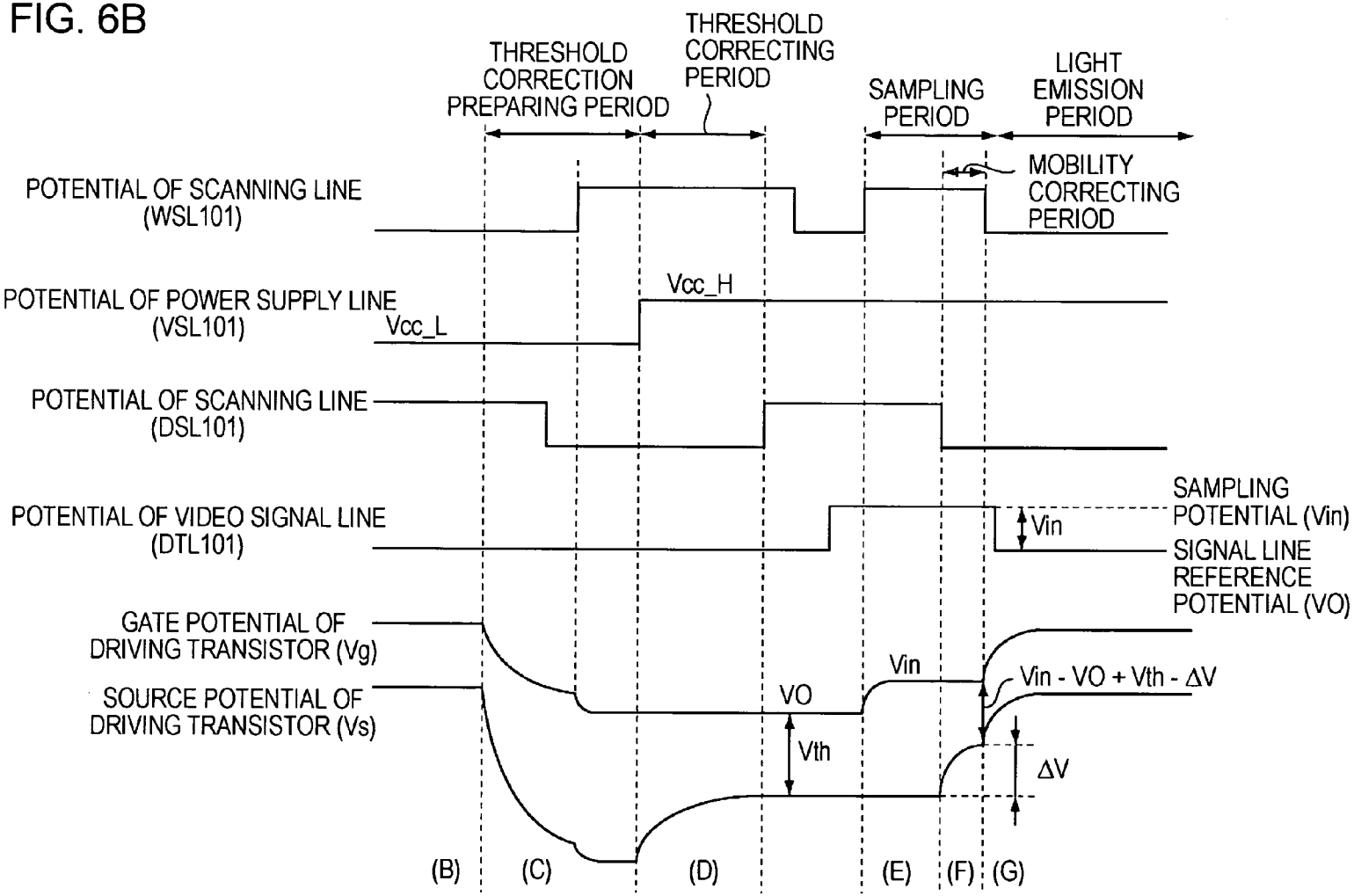
FIG. 6B is a timing chart for illustrating an operation according to the third embodiment.

On the other hand, in the configuration according to this embodiment, as shown in the timing chart shown in FIG. 6B, an initializing potential Vcc_L is supplied to the power supply line VSL101 and the potential of the scanning line DSL101 is changed to a low level so as to turn ON the transistor 1C, so that the source potential Vs of the driving transistor 1B is initialized. Then, the potential of the power supply line VSL101 is returned to a normal potential Vcc_H, so that the threshold voltage correcting operation is performed. In the sampling period (E), the potential of the signal line DTL101 is changed to the sampling potential Vin, and then the sampling transistor 1A is turned ON again, so that sampling can be performed. In this circuit, too, the mobility correcting period (F) is determined depending on the phase difference between the first timing when the emission time controlling transistor 1C is turned ON and the second timing when the sampling transistor 1A is turned OFF, and thus advantages of the present invention can be obtained. According to the above-described embodiments of the present invention, the same mobility correcting period (F) can be obtained in each line and variations in brightness in raster display can be improved.

Figure 7:
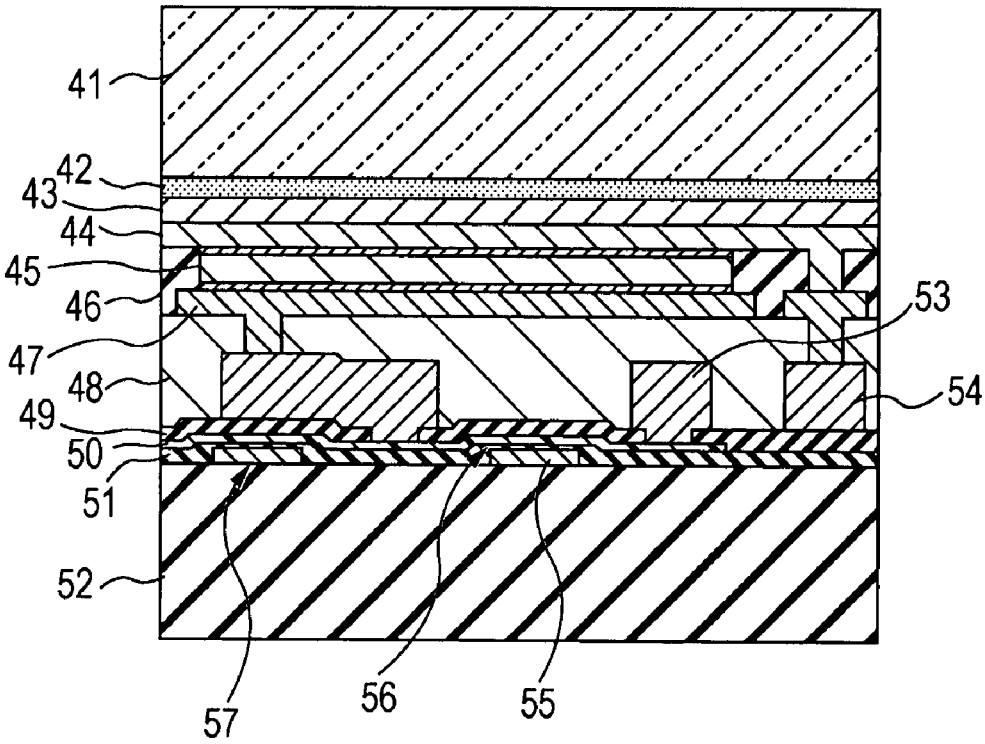
FIG. 7 is a cross sectional view showing a device configuration of the display device according to any of the embodiments of the present invention.

The display device according to any of the embodiments of the present invention has a thin film device configuration as shown in FIG. 7. FIG. 7 shows a schematic cross sectional structure of a pixel formed on an insulating substrate. As shown in FIG. 7, this thin firm device configuration includes an opposite substrate 41, an adhesive 42, a protective film 43, a cathode electrode 44, a light-emitting layer 45, a wind insulating film 46, an anode electrode 47, a planarizing layer 48, an insulating film 49, a semiconductor layer 50, a gate insulating film 51, a substrate 52, signal wiring 53, auxiliary wiring 54, and a gate electrode 55. The pixel includes a transistor unit 56 including a plurality of thin film transistors (only one TFT is shown as a representative), a capacitance unit 57 including a holding capacitance, and a light-emitting unit including an organic EL element. The transistor unit 56 and the capacitance unit 57 are formed on the substrate 52 by a TFT process, and the light-emitting unit including an organic EL element is laminated thereon. The opposite substrate 41, which is transparent, is provided thereon via the adhesive 42, so that a flat panel is fabricated.

Figure 8:
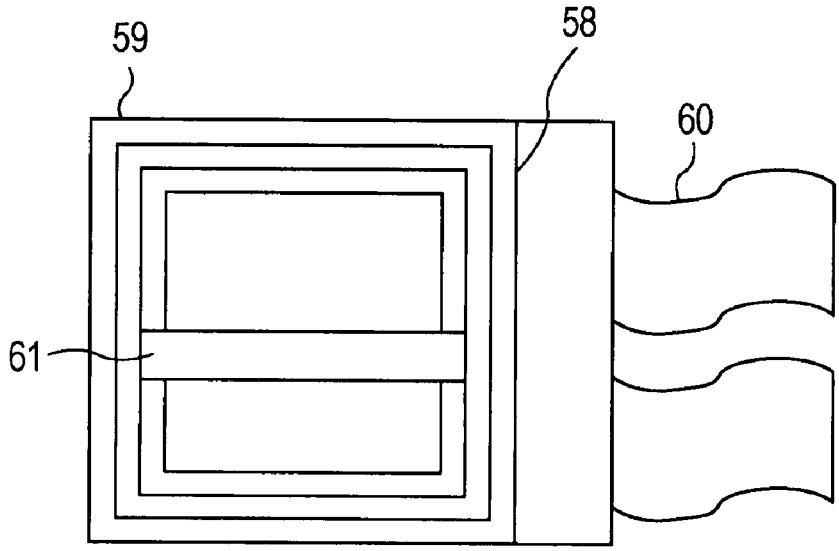
FIG. 8 is a plan view showing a module configuration of the display device according to any of the embodiments of the present invention.

The display device according to any of the embodiments of the present invention includes a display device of a flat module shape, as shown in FIG. 8. For example, a pixel array unit (pixel matrix unit 61) in which pixels including organic EL elements, thin film transistors, and thin film capacitances are integrally formed in a matrix pattern is provided on an insulating substrate 58, an adhesive is provided around the pixel array unit, and an opposite substrate 59 made of glass or the like is laminated thereon, so as to fabricate a display module. A color filter, a protective film, a shielding film, and so on may be provided on the transparent opposite substrate as necessary. Also, an FPC (flexible print circuit), serving as a connector 60 to input/output signals to/from the pixel array unit, may be provided in the display module.

The display device according to any of the above-described embodiments of the present invention has a flat panel shape and can be applied to displays of various electronic apparatuses, more specifically, displays of electronic apparatuses of various fields for displaying video signals input to or generated by the apparatus in a from of image or video. Examples of such electronic apparatuses include a digital camera, a notebook personal computer, a mobile phone, and a video camera. Hereinafter, these examples are described.

Figure 9:
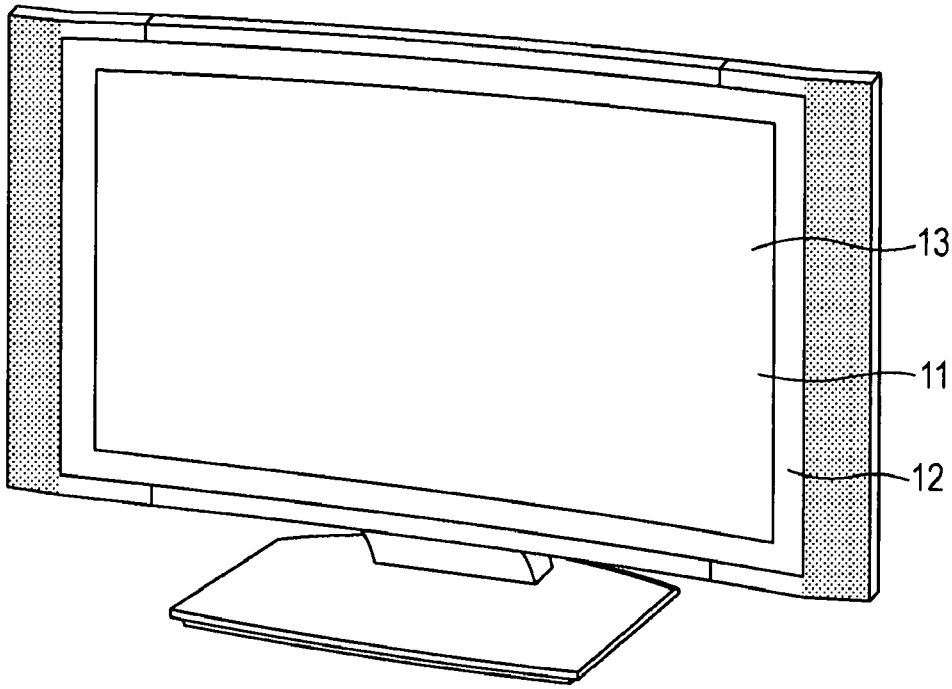
FIG. 9 is a perspective view showing a television set including the display device according to any of the embodiments of the present invention.

FIG. 9 shows a television set to which the display device according to any of the embodiments of the present invention is applied. The television set includes a video display screen 11 including a front panel 12 and a filter glass 13, and is manufactured by using the display device according to any of the embodiments of the present invention as the video display screen 11.

Figure 10:
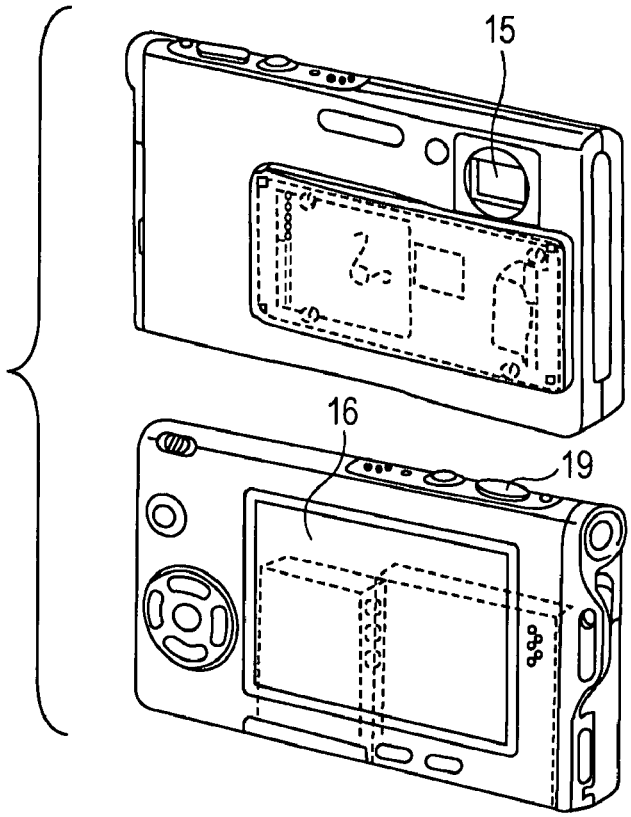
FIG. 10 is a perspective view showing a digital still camera including the display device according to any of the embodiments of the present invention.

FIG. 10 shows a digital camera to which the display device according to any of the embodiments of the present invention is applied. The upper part is a front view and the lower part is a back view. This digital camera includes an image taking lens, a light-emitting unit 15 for flash, a display unit 16, a control switch, a menu switch, and a shutter 19, and is manufactured by using the display device according to any of the embodiments of the present invention as the display unit 16.

Figure 11:
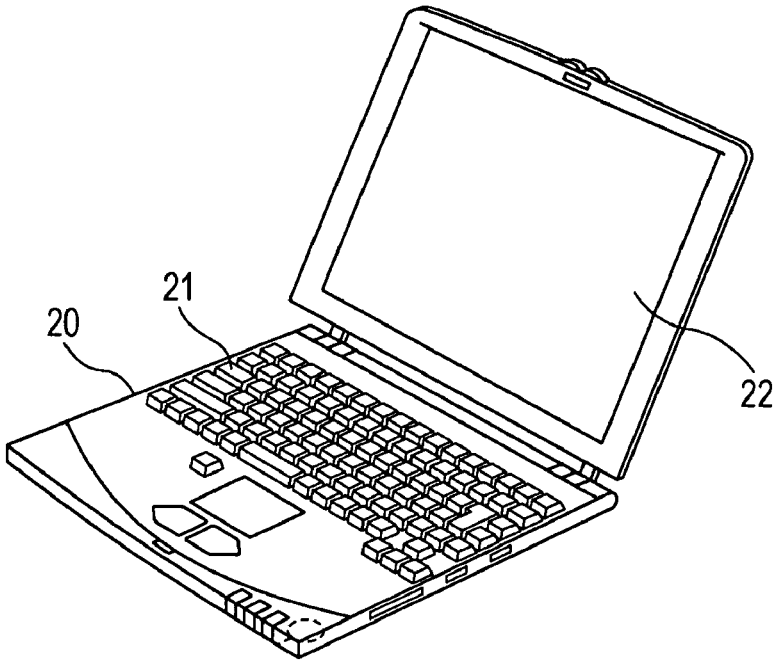
FIG. 11 is a perspective view showing a notebook personal computer including the display device according to any of the embodiments of the present invention.

FIG. 11 shows a notebook personal computer to which the display device according to any of the embodiments of the present invention is applied. A main body 20 includes a keyboard 21 operated to input characters and so on. A cover includes a display unit 22 to display images. This notebook personal computer is manufactured by using the display device according to any of the embodiments of the present invention as the display unit 22.

Figure 12:
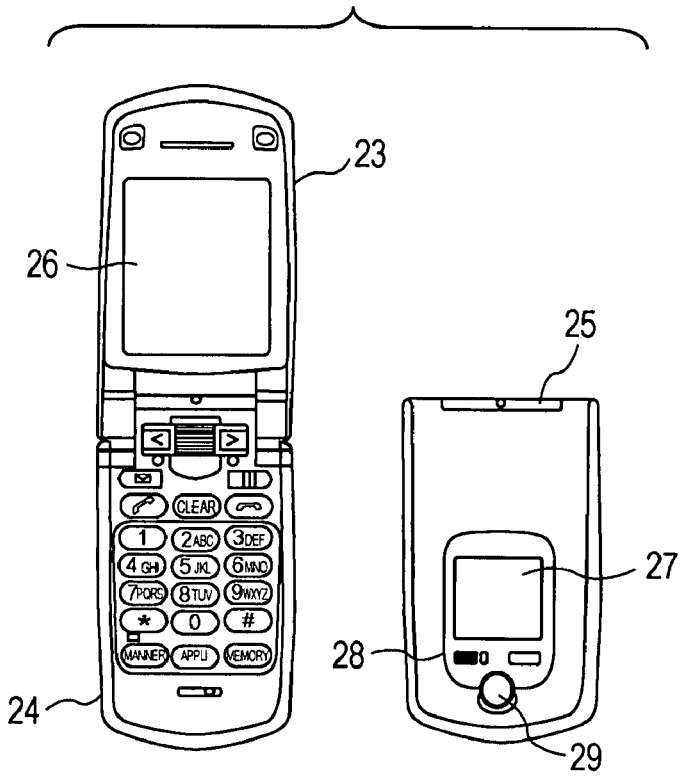
FIG. 12 is a schematic view showing a mobile terminal including the display device according to any of the embodiments of the present invention.

FIG. 12 shows a mobile terminal to which the display device according to any of the embodiments of the present invention is applied. The left part shows an open state and the right part shows a closed state. This mobile terminal includes an upper casing 23, a lower casing 24, a connecting portion (hinge unit) 25, a display 26, a sub-display 27, a picture light 28, and a camera 29. The mobile terminal is manufactured by using the display device according to any of the embodiments of the present invention as the display 26 and the sub-display 27.

Figure 13:
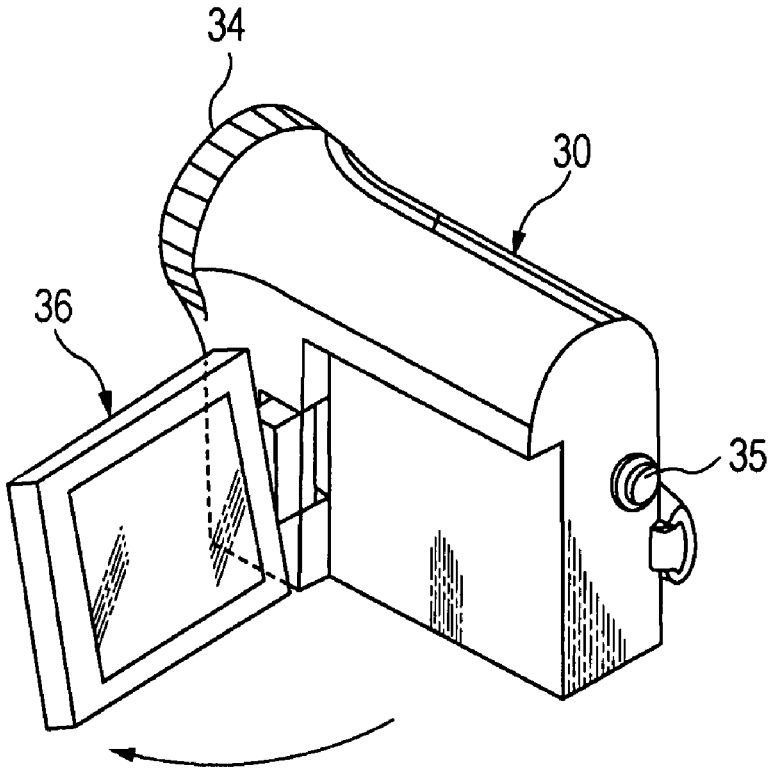
FIG. 13 is a perspective view showing a video camera including the display device according to any of the embodiments of the present invention.

FIG. 13 shows a video camera to which the display device according to any of the embodiments of the present invention is applied. The video camera includes a main body 30, a lens 34 for shooting a subject provided on a front side, a shooting start/stop switch 35, and a monitor 36. The video camera is manufactured by using the display device according to any of the embodiments of the present invention as the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array unit; and a peripheral circuit unit, the pixel array unit including first scanning lines arranged in rows;

second scanning lines arranged in rows;

signal lines arranged in columns; and pixels arranged in a matrix pattern at intersections of the scanning lines and the signal lines, the peripheral circuit unit including a first scanner to supply first control pulses to the first scanning lines;

a second scanner to supply second control pulses to the second scanning lines; and a signal driver to supply video signals to the signal lines, each of the pixels including at least a sampling transistor;

a driving transistor;

an emission time controlling transistor;

a holding capacitance; and a light-emitting element, the sampling transistor being turned ON in accordance with the first control pulse, sampling the video signal, and allowing the holding capacitance to hold the video signal, the driving transistor controlling a drive current in accordance with a potential of the video signal held in the holding capacitance, the emission time controlling transistor being turned ON in accordance with the second control pulse and supplying the drive current controlled by the driving transistor to the light-emitting element, and the light-emitting element emitting light by receiving the drive current while the emission time controlling transistor is in an ON state, wherein the drive current is negatively fed back to the holding capacitance in a correcting period from a first timing when the emission time controlling transistor is turned ON after the sampling transistor has been turned ON to a second timing when the sampling transistor is turned OFF, thereby correcting variations in mobility of the driving transistor among the pixels, wherein the first scanner forms an edge of the first control pulse defining the second timing by using a first enable signal supplied from the outside, and wherein the second scanner forms an edge of the second control pulse defining the first timing by using a second enable signal supplied from the outside.

2. The display device according to claim 1, wherein the correcting period is optimized by adjusting a phase difference between the first enable signal and the second enable signal.

3. The display device according to claim 1, wherein each of the pixels has correcting means for correcting variations in threshold voltage of the driving transistor among the pixels.

4. An electronic apparatus including the display device according to claim 1.

5. A method for driving a display device including a pixel array unit and a peripheral circuit unit, the pixel array unit including first scanning lines arranged in rows; second scanning lines arranged in rows; signal lines arranged in columns; and pixels arranged in a matrix pattern at intersections of the scanning lines and the signal lines, the peripheral circuit unit including a first scanner to supply first control pulses to the first scanning lines; a second scanner to supply second control pulses to the second scanning lines; and a signal driver to supply video signals to the signal lines, each of the pixels including at least a sampling transistor; a driving transistor; an emission time controlling transistor; a holding capacitance; and a light-emitting element, the method comprising:

turning ON the sampling transistor in accordance with the first control pulse, sampling the video signal from the signal line, and allowing the holding capacitance to hold the video signal, controlling, by the driving transistor, a drive current in accordance with a potential of the video signal held in the holding capacitance, turning ON the emission time controlling transistor in accordance with the second control pulse and supplying the drive current controlled by the driving transistor to the light-emitting element, emitting, by the light-emitting element, light by receiving the drive current while the emission time controlling transistor is in an ON state, negatively feeding back the drive current to the holding capacitance in a correcting period from a first timing when the emission time controlling transistor is turned ON after the sampling transistor has been turned ON to a second timing when the sampling transistor is turned OFF, thereby correcting variations in mobility of the driving transistor among the pixels, forming, by the first scanner, an edge of the first control pulse defining the second timing by using a first enable signal supplied from the outside, and forming, by the second scanner, an edge of the second control pulse defining the first timing by using a second enable signal supplied from the outside.

* * * * *